US006685082B2

(12) United States Patent
Frohne et al.

(10) Patent No.: US 6,685,082 B2
(45) Date of Patent: Feb. 3, 2004

(54) PROCESS FOR CONTINUOUS PRODUCTION OF LONGITUDINALLY WELDED METAL TUBING

(75) Inventors: Christian Frohne, Hannover (DE); Klaus Porcher, Lehrte (DE)

(73) Assignee: Nexans, Paris (FR)

( * ) Notice: Subject to any disclaimer, the term of this patent is extended or adjusted under 35 U.S.C. 154(b) by 44 days.

(21) Appl. No.: 10/273,269

(22) Filed: Oct. 18, 2002

(65) Prior Publication Data

US 2003/0075588 A1 Apr. 24, 2003

(30) Foreign Application Priority Data

Oct. 20, 2001 (DE) ..... 101 51 827

(51) Int. Cl.[7] ..... B23K 1/00; B23K 26/00
(52) U.S. Cl. ..... 228/173.7; 228/174; 219/121.64
(58) Field of Search ..... 228/165, 173.4, 228/173.6, 173.7, 174, 175, 17.5; 219/121.63, 121.64

(56) References Cited

U.S. PATENT DOCUMENTS 3,794,803 A * 2/1974 Valdeck ..... 219/61
3,874,076 A * 4/1975 Tsukamoto et al. ..... 29/828
4,048,705 A * 9/1977 Blanpain et al. ..... 419/61
4,137,446 A * 1/1979 Blanpain et al. ..... 219/145.22
4,154,976 A * 5/1979 Brorein ..... 174/115
4,283,824 A * 8/1981 Schatz et al. ..... 29/890.045
4,315,132 A * 2/1982 Saurin et al. ..... 219/121.64
4,331,281 A * 5/1982 Klebl et al. ..... 228/125
5,192,016 A * 3/1993 Araki et al. ..... 228/147
5,582,748 A * 12/1996 Yoshie et al. ..... 219/121.64
5,628,447 A * 5/1997 Ziemek ..... 228/147
5,653,898 A * 8/1997 Yoshie et al. ..... 219/121.63
2003/0075588 A1 * 4/2003 Frohne et al.

FOREIGN PATENT DOCUMENTS

EP 0423378 A1 * 4/1991

* cited by examiner

*Primary Examiner*—Kiley Stoner
(74) *Attorney, Agent, or Firm*—Sughrue Mion, PLLC

(57) ABSTRACT

In a process for continuous production of longitudinally welded metal tubing, in which a metal strip is withdrawn from a strip supply, gradually shaped into a tubing with an open longitudinal slit, and the longitudinal slit is sealed by soldering or welding, a lubricant is introduced into the open slit tubing before sealing.

6 Claims, 1 Drawing Sheet

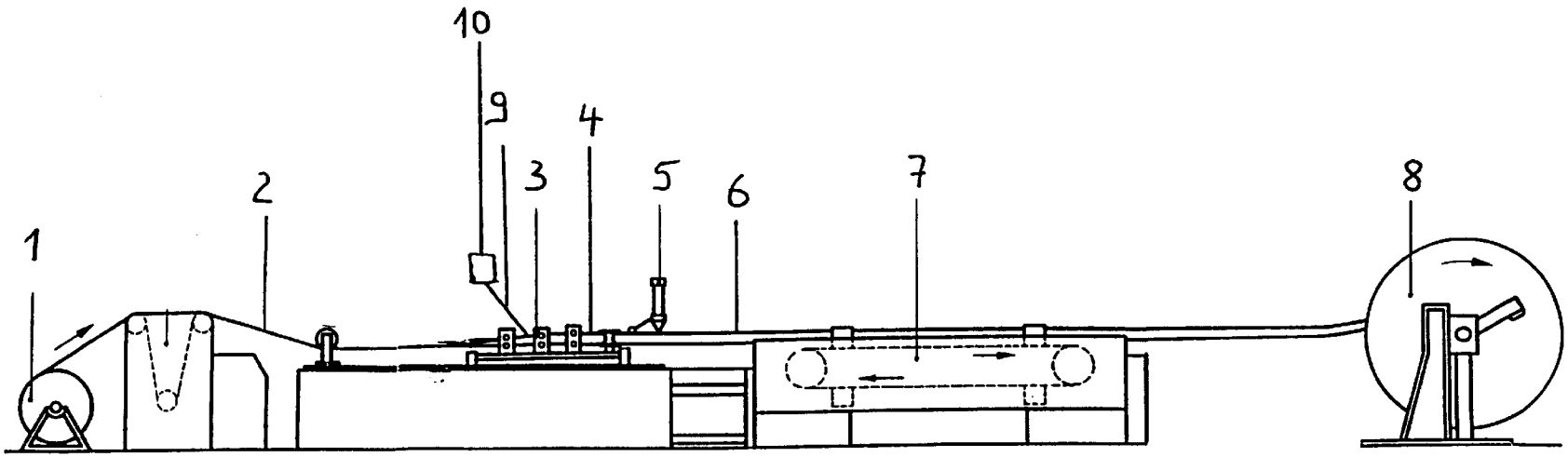
8
7
6
5
4
3
9
10
2
1

PROCESS FOR CONTINUOUS PRODUCTION OF LONGITUDINALLY WELDED METAL TUBING

This application is based on and claims the benefit of German Patent Application No. 10151827.7 which is incorporated by reference herein.

DESCRIPTION

The present invention relates to a process for continuous production of longitudinally welded metal tubing, in which a metal strip is withdrawn from a strip supply, gradually shaped into tubing with an open longitudinal slit, and the longitudinal slit is sealed by soldering or by welding at a welding point.

The continuous production of longitudinally welded metal tubing—either smooth or corrugated—has been known for a long time.

The technical brochure entitled Uniwema-Maschinen und Zubehör (Uniwema Machines and Accessories) by kabelmetal electro GmbH describes a process by means of which metal tubing with a diameter of 2 to 400 mm and a wall thickness of 0.05 to 4.0 mm can be produced in nearly infinite lengths.

In this process, a metal strip is withdrawn from a reel, possibly cleaned, shaped into slit tubing in a plurality of shaping steps on a shaping table, and the longitudinal slit of the tubing is welded in a welding unit. Behind the welding unit, the metal tubing is grasped by a so-called collet feed, which transports the metal strip and the metal tubing at a uniform speed. For this purpose, the collets, which are mounted on two endless roller chains, enclose the tubing. The collets are provided with jaws that are precisely adapted to the diameter of the tubing The welded tubing is then usually wound onto a cable reel.

The problem with this prior-art process is that due to the shaping of the metal strip into the slit tubing and the welding of the longitudinal edges, tubing with an outside diameter of less than 2 mm can no longer be produced. To be able to produce tubing with a smaller diameter, the tubing must be reduced in one or several steps. This is accomplished by pulling the tubing through a die, the inside diameter of which is smaller than the outside diameter of the tubing to be reduced. If the wall thickness of the tubing is also to be reduced in this drawing process, a mandrel, the outside diameter of which is greater than the inside diameter of the die, must be inserted into the tubing.

To reduce friction between the tubing wall and the shaping tools (i.e., the die and mandrel), a lubricant must be added. Lubricating the tube from the outside presents few problems. It is difficult, however, to introduce the required amount of lubricant into the interior of the tubing, if the tubing lengths to be drawn are large.

SUMMARY OF THE INVENTION

In view of the above, an object of the invention is to define a process suitable for producing metal tubing of great lengths, which in a subsequent process step can be easily reduced both with respect to the outside diameter and the wall thickness.

This object is attained by a method as described above, further including the step of introducing a lubricant into the open slit tubing. The lubricant can be a lubricating oil introduced in drops behind the welding point, and may be introduced in an amount sufficient to coat the entire inner surface of the metal tubing.

The essential advantage of the invention is that it provides a simple method for coating the inner surface with a precisely metered amount of lubricant, so that the subsequent drawing process can be performed without difficulties, i.e. without damaging the inner surface of the tubing, and thus without risk that the tubing may tear off behind the die.

BRIEF DESCRIPTION OF THE DRAWINGS

The invention will now be described in greater detail with reference to an exemplary embodiment schematically depicted in the drawing.

DETAILED DESCRIPTION OF THE INVENTION

A metal strip 2 made, for instance, of austenitic steel, is withdrawn from a supply reel 1 and is fed to a set of shaping rollers 3 in which the metal strip 2 is gradually shaped into tubing 4 with a longitudinal slit. This longitudinal slit is sealed by means of a welding unit 5, preferably a laser welding device. The welded tubing 6 is grasped behind welding unit 5 by a collet feed 7, which transports the metal strip 2, the slit tubing 4, and the welded tubing 6 through the production unit. The collet feed is described in the Examined German Application 11 64 355.

The welded tubing 6 is subsequently wound onto a cable drum 8.

The described process is limited to tubing with a maximum outside diameter of 2 mm. There is a need for metal tubing with an outside diameter of 0.2 mm and a wall thickness of 0.02 mm. Such metal tubing is used for the production of hypodermic needles.

To be able to produce metal tubing with these dimensions, the longitudinally welded tubing produced according to the described process must be reduced to the desired dimensions by drawing in several steps.

To prepare the longitudinally welded tubing for the subsequent drawing operation, the invention provides that the metal tubing 6 be provided with a lubricant film along its interior surface. For this purpose, a lance 9 introduces a lubricant from a reservoir 10 into slit tubing 4 or metal tubing 6.

It is particularly advantageous to position the end of lance 9 behind the welding unit to prevent the lubrication properties of the lubricant from being affected by the welding heat.

Lance 9 can discontinuously introduce the lubricant into the still open tubing 4 or into welded tubing 6. As the tubing is subsequently wound onto a cable drum 8 or a reel, the lubricant is distributed over the entire inner surface of tubing 6.

Alternatively, the lubricant can be applied by spraying a thin film onto the inner surface of tubing 6 behind welding unit 5. The process according to the invention can by used to produce longitudinally welded tubing of large lengths, i.e. up to 20,000 m or more, from which tubing with a substantially smaller outside diameter and a substantially smaller wall thickness is produced in a subsequent drawing process.

What is claimed is:

1. A method for continuous production of longitudinally welded metal tubing, in which a metal strip is withdrawn from a strip supply, gradually shaped into tubing with an open longitudinal slit, and the longitudinal slit is sealed by soldering or by welding at a welding point, said method further including the step of introducing a lubricant into the open slit tubing, wherein the welded tubing is wound into a bundled coil or onto a reel, and further wherein the lubricant is introduced into the open slit tubing in such an amount that the entire inner surface of the metal tubing is coated with lubricant after the tubing is wound up.

2. A method as claimed in claim 1, wherein said lubricant comprises a lubricating oil.

3. A method as claimed in claim 1, wherein the lubricant is introduced in drops.

4. A method as claimed in claim 1, wherein the longitudinal slit is sealed by laser welding.

5. A method as claimed in claim 1, wherein, in a subsequent process step, both the outside diameter and the wall thickness of the metal tubing are reduced by means of a drawing process using a mandrel in the interior of the tubing and a drawing die.

6. A method for continuous production of longitudinally welded metal tubing, in which a metal strip is withdrawn from a strip supply, gradually shaped into tubing with an open longitudinal slit, and the longitudinal slit is sealed by soldering or by welding at a welding point, said method further including the step of introducing a lubricant into the open slit tubing, wherein the lubricant is introduced into the metal tubing by means of a lance behind the welding point.

* * * * *